US009355513B2

(12) United States Patent
Robinson

(10) Patent No.: US 9,355,513 B2
(45) Date of Patent: May 31, 2016

(54) COIN APPARATUS

(71) Applicant: Innovative Technology Limited, Oldham (GB)

(72) Inventor: John Robinson, Oldham (GB)

(73) Assignee: Innovative Technology Limited, Oldham (GB)

( * ) Notice: Subject to any disclaimer, the term of this patent is extended or adjusted under 35 U.S.C. 154(b) by 0 days.

(21) Appl. No.: 14/716,962

(22) Filed: May 20, 2015

(65) Prior Publication Data

US 2015/0371479 A1 Dec. 24, 2015

(30) Foreign Application Priority Data

Jun. 23, 2014 (GB) ..... 1411100.9

(51) Int. Cl.
*G07D 1/00* (2006.01)
*G07D 9/00* (2006.01)

(52) U.S. Cl.
CPC . *G07D 9/008* (2013.01); *G07D 1/00* (2013.01)

(58) Field of Classification Search
CPC ..... G07D 1/00; G07D 2201/00; G07D 9/00; G07D 9/008
USPC ..... 453/33, 39, 49–52, 57
See application file for complete search history.

(56) References Cited

U.S. PATENT DOCUMENTS 6,059,650 A * 5/2000 Stoltz ..... G07D 9/008 198/803.16

FOREIGN PATENT DOCUMENTS

EP 1 842 168 B1 1/2012
EP 1 842 168 B1 * 1/2012 ..... G07D 9/00

* cited by examiner

*Primary Examiner* — Mark Beauchaine
(74) *Attorney, Agent, or Firm* — Woodard, Emhardt, Moriarty, McNett & Henry LLP

(57) ABSTRACT

An apparatus (30) for separating a single coin from a plurality of coins comprising a rotatable coin disk (31) including at least one coin-retaining aperture, said rotatable coin disk configured to transport coins along a dispensing path interconnecting a coin source and a coin outlet aperture, said coin outlet aperture closed by a double outlet gate (32); characterized in that said double outlet gate (32) comprises adjacent first and second gate members (33, 34), wherein the first gate member (33) is a biased moveable coin stripping element and the second gate member (34) is a fixed barrier including an aperture section (37) configured to allow the unhindered passage therethrough of a separated coin.

15 Claims, 4 Drawing Sheets

COIN APPARATUS

REFERENCE TO RELATED APPLICATIONS

This application claims priority of Great Britain Application No. 14 111 00.9, filed 23 Jun. 2014, the disclosure of which is incorporated herein by reference in its entirety.

The present invention relates to improvements in coin separation, sorting and identification. In particular, the present invention relates to an apparatus for separating a single coin from a bulk supply of coins.

The term 'coin' is used to mean any discoid body such as, but not limited to, monetary coins, tokens, medals and other such similar items.

A key aspect of the functioning of any coin sorting device, be it a coin hopper or a coin recycler, is to extract single coins from a bulk supply of coins in an efficient, repeatable and reliable manner.

It is frequently desirable that a coin sorting device should be able to accommodate and sort coins of more than one denomination. Such devices are therefore required to handle coins of various diameters, thickness and shape.

A well-known problem with conventional devices that are configured to accept various denominations of coin is that erroneous dual coin dispensing can occur when a pair of relatively thinner coins 'mimic' a single thicker coin by stacking one upon the other.

A prior art approach to the above mentioned double coin problem is disclosed in EP-B-1,842,168.

EP-B-1,842,168 discloses a coin separating mechanism comprising a rotatable coin disk, a coin diverter, and a double outlet gate. The rotatable coin disk includes a plurality of coin receiving apertures, and the double outlet gate is constituted by a pair of singulators arranged to prevent the egress of more than one coin at a time from the mechanism into a coin dispensing channel. FIG. 1 shows a plan view of the prior art mechanism, and FIG. 2 is a sectional elevation view along the line A-A shown in FIG. 1.

With reference to FIGS. 1 and 2, the rotatable coin disk 2 of the coin separating mechanism 1 includes a plurality of coin receiving apertures 4. Also shown, supported by base structure 9, is a double outlet gate 6 obstructing a coin outlet aperture 5.

The double outlet gate 6 comprises an inner first gate member 7, and an outer second gate member 8. The first and second gate members are resiliently biased and they respectively function as inner and outer coin singulators.

The inner and outer gate members 7, 8 are arcuate in shape, are mounted to the base structure 9, and are accommodated within an outer annular chamber 13 of the rotatable coin disk 2.

The attachment of the gate members 7, 8 to the base structure 9 is via pairs of biased support posts 12, each of which are connect to the base structure 9 through a respective spring (only two are shown in FIG. 2). A first pair of springs 10 connects to the first gate member 7, and a second pair of springs 11 connects to the second gate member 8. The spring pairs 10, 11 bias the gate members 7, 8 towards the base structure 9.

The inner first gate member 7 has an inner concave bevelled surface 14, and the outer second gate member 8 has an inner concave bevelled surface 15 that follows the contour of the outer convex shape of the inner first gate member 7.

In the absence of coins, the lower surface of the first gate member 7 is held immediately adjacent to the upper surface of the base structure 9. In this way, the entire width of the coin dispensing channel 16 is obstructed and blocked by the double outlet gate 6. The outer second gate member 8 is similarly held adjacent to the upper surface of the base structure 9 in an adjacent and concentric disposition with respect to the first gate member 7.

When a single coin that is supported in a flat position on the upper surface of the base structure 9 is forced against the first inner concave bevelled surface 14 by the action of the rotatable coin disk 2 and the coin diverter 3, it engages with the first gate member 7 and lifts it against the biasing force of the springs 10. In this way the coin is urged under and passed the first gate member where it encounters the second gate member 8. In a similar manner, the coin is urged forwards against the second inner concave bevelled surface 15 forcing the second gate member 8 upwards against the biasing force of the second pair of springs 11. In this way, the path to the coin dispensing channel 16 becomes open to a single coin only by the action of the double outlet gate 6.

However, a problem exists with the above described prior art coin mechanism in that small coins, for example a 1 cent euro coin (€0.01), cause disproportionate wear to the mechanism when compared to coins of a larger dimension, and €0.01 coins also produce an increase in the frequency of coin mechanism reversing operations that result when a coin jams. Typically, with coins of a larger diameter, the rotatable coin disk of a coin separating mechanism will undergo a reversing operation once in every 10,000 coins. When the bulk supply of coins being processed contains about 20% of €0.01 coins, reversing operations occur once in every 500 coin cycles.

Another problem with the aforementioned conventional mechanism arises when several coins are simultaneously received in a coin receiving aperture. For example, when a relatively smaller coin becomes lodged behind a pair of larger coins stacked within the coin receiving aperture in a piggyback formation (see FIGS. 7A and 7B), a situation can arise where the smaller coin acts as a wedge to push both of the stacked coins through the double outlet gate by forcing both the inner and the outer gate members upwards to allow ejection of the two coins simultaneously.

The problems associated with the prior art coin separating mechanism will now be discussed with reference to FIGS. 3, 4, 7A and 7B.

As shown in FIG. 3, a relatively large coin 17, for example a €1 coin, is diverted by a coin diverter 3 and urged outwards 17' through the double outlet gate 6. At this juncture, the coin 17 is in contact with the underside of the second gate member 8. The leading edge of an outer portion of the rotatable coin disk 2 impacts 21 on the coin 17 exerting additional impetus on the coin so as to overcome the friction arising from contact with the second gate member 8. The impact of the coin disk 2 with the coin 17 deflects it from an edge 20 of the mouth of the coin dispensing channel 16 into the coin dispensing channel 16.

In contrast, and as shown in FIG. 4, a relatively smaller coin 18, for example a €0.01 coin, when diverted by diverter 3 and urged outwards 18' through the outlet gate has a greater proportion of its surface area in contact with the underside of the second gate member 8, consequently the friction force tending to hold the coin in place is relatively greater than is the case with a larger coin. Furthermore, the impact of the leading edge of an outer portion of the rotatable coin disk 2 with a €0.01 coin is not off-centre with respect to the geometric centre of the coin, as is the case with larger coins. Here, the impact line of force 22 tends to be directed through the centre of the coin leading to an increased risk of coin jamming and greater wear on both the edge 20 of the mouth of the coin dispensing channel 16 and the rotatable coin disk 2.

The present invention arose from attempts at providing an improved coin separating mechanism that addresses the above described problem.

According to an aspect of the present invention there is provided an apparatus as defined in claim 1.

Preferably, the rotatable coin disk is disposed adjacent the coin source for filling the at least one coin-retaining aperture, and the apparatus includes a deflecting member configured to urge, in use, a coin located in the at least one coin-retaining aperture towards said coin outlet aperture.

Advantageously, the fixed barrier aperture section is dimensioned such that it will accommodate the thickest coin that the apparatus is intended to be use with.

The fixed barrier aperture section has a height dimension d, and d is preferably in the range 2 mm≤d≤3 mm.

In a preferred embodiment, a motor is arranged to drive the rotatable coin disk, and the rotatable coin disk includes urging means configured and arranged to cooperate with the deflecting member. During operation of the apparatus, the urging means pushes a coin located in a coin-retaining aperture along the dispensing path via rotation of the disk.

Advantageously, during operation the urging means and the deflecting member comb through one another each rotation of the rotatable coin disk so as to provide continuous relative rotational movement between the urging means and the deflecting member. Also, the deflecting member is arranged such that in use it contacts only one coin at a time, and it is spring biased so as to be movable into a retracted position to prevent a coin jam.

Preferably, the first gate member includes a tapered concave coin contacting surface. During operation of the apparatus, this contacting surface translates the urging force of a leading edge of a coin into a displacement force that displaces the first gate member upwards out of the coin dispensing path to allow the coin to pass under the first gate member and through the fixed barrier aperture section.

In a preferred embodiment the first and second gate members have a complementary arcuate shape, and the first gate member comprises respective first and second ends which are held in place by spring biased support posts mounted at their respective first and second ends. In contrast, the second gate member comprises respective first and second ends which are fixed to a base structure of said apparatus.

An embodiment of the present invention will now be described, by way of example only, and with reference to the accompanying schematic drawings, in which.

Figure 5:
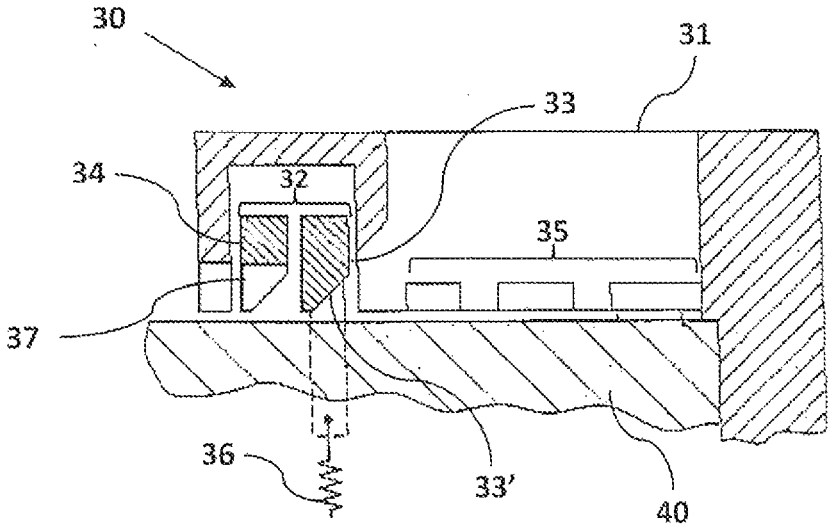
FIG. 5 is a partial sectional elevation view of the coin apparatus of the present invention.
Figure 6A:
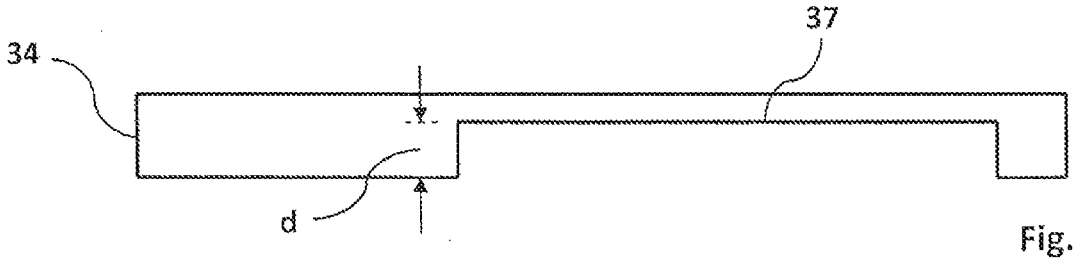
FIG. 6A shows an elevation view of the outer gate member of the coin apparatus of the present invention.
Figure 6B:
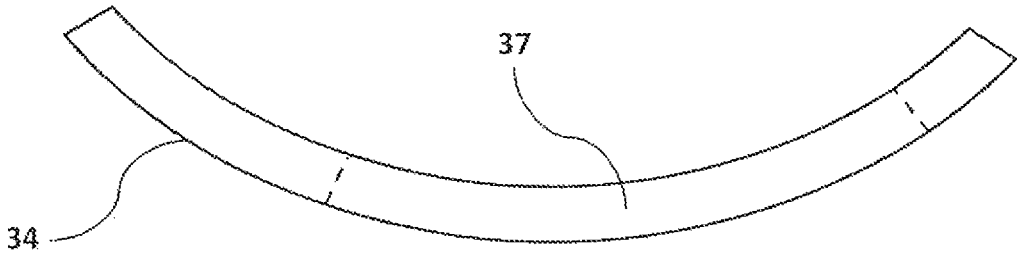
FIG. 6B shows a plan view of the outer gate member of the coin apparatus of the present invention.

With reference to FIGS. 5 to 6B, the coin apparatus of the present invention provides a coin separating mechanism including a double outlet gate 32 comprising an inner gate member 33 and an outer gate member 34. The mechanism also includes a segmented coin diverter 35 disposed on the base structure 40 radially inwards from the double outlet gate 32.

The inner gate member 33, the operation of which is described fully in EP-B-1,842,168, has an arcuate shape with a bevelled inner coin contacting surface 33'. Opposing ends of the inner gate member 33 are connected to the base structure 40 of the coin apparatus 30 via a pair of biasing springs 36 (only one of which is shown in FIG. 5).

In contrast to the inner gate member 33, the outer gate member 34 is a fixed barrier constructed so as to compliment the radially outer curvature of the inner gate member. The outer gate member is fixed directly to the base structure 40 without any biasing means, springs or the like.

With reference to FIGS. 6A and 6B, the inner gate member 34 is arcuate in shape and includes an aperture section 37 cut from the underside of the gate. The aperture section 37 provides a clear exit for a single coin emanating from beneath the inner gate member 33 as it is urged upwards by the exiting coin.

The vertical dimension d of the aperture section 37 is sized such that a single coin of a coin denomination having the maximum allowable thickness can pass unhindered through the outer gate member 34. Typically, the height dimension d of the aperture section 37 will be in the range 2 mm≤d≤3 mm.

Figure 7A:
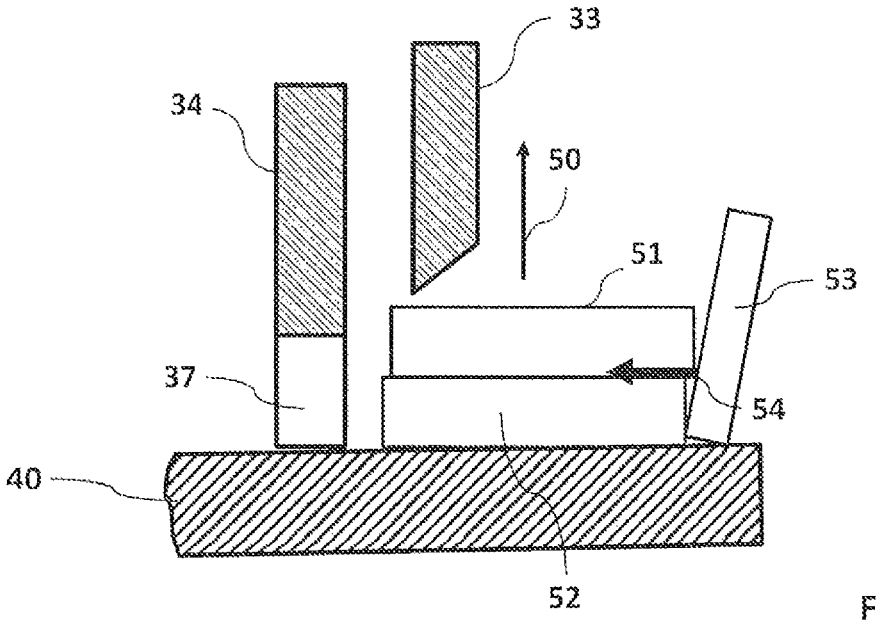
FIGS. 7A and 7B show the process by which the apparatus of the present invention prevents double-coin ejection.
Figure 7B:
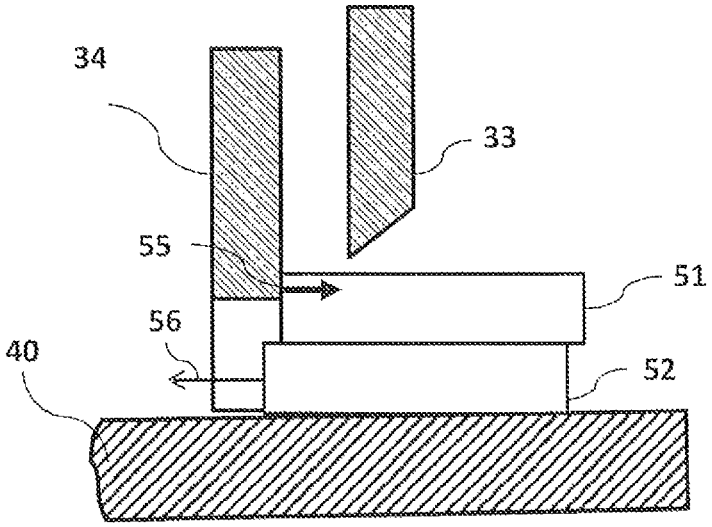

In operation, and as shown in FIGS. 7A and 7B, the simultaneous ejection of two coins in piggyback formation is prevented by the presence of the fixed, outer gate member 34.

In the example shown in FIGS. 7A and 7B, three coins 51, 52 and 53 are all lodged within the same receiving aperture (not shown). Coins 51 and 52 are the same size and have become horizontally stacked one atop the other in a piggyback formation. Coin 53 is of a relatively smaller size than each coin of the stacked pair of coins 51, 52, and coin 53 has become jammed in a substantially vertical position behind the stacked pair of coins. In this position, coin 53 acts as a wedge providing an urging force 54 in the direction of the inner gate member 33, and this force acts on both coin 51 and coin 52.

As a result of the wedge effect of coin 53, the stacked coins 51 and 52 are urged forward in unison to thereby push the inner gate member 33 upwards allowing both coins to pass underneath the inner gate member 33.

After passing underneath the inner gate member 33, the stacked-coin pair 51, 52 encounters the outer gate member 34. Since the outer gate member 34 is fixed, the coins cannot force the gate member upwards and the upper most coin 51 of the coin pair abuts the inner surface of the outer gate member 34 at a position just above the aperture section 37. A deflection force 55 urges the upper coin 51 backwards and the bottom coin 52 continues in a forward direction 56, thus passing through the aperture 37 as a separated coin from the stacked pair.

As mentioned above, the height of the aperture is between 2 mm and 3 mm, and this dimension allows passage of a single coin of any thickness from within the range of coins the apparatus is intended to be used with. On the other hand, this dimension is such that it will prevent passage of a pair of the thinnest coins in a stacked arrangement and will ensure that only a single coin is allowed to pass through the fixed aperture section 37.

Figure 1:
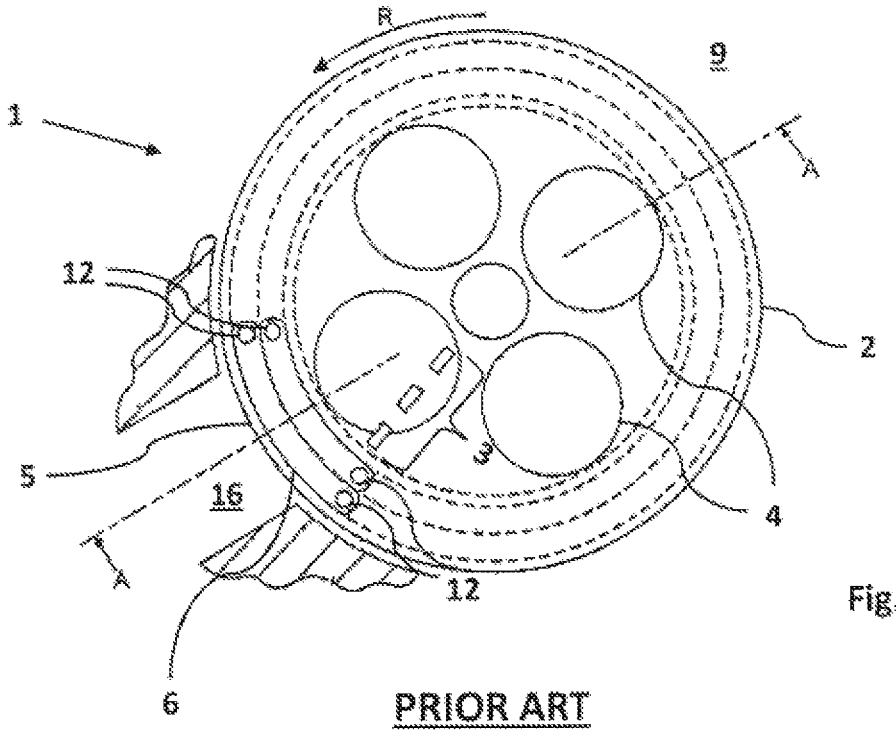
Fig. 1. PRIOR ART
FIG. 1 is a partial sectional plan view of a prior art coin separating mechanism.
Figure 2:
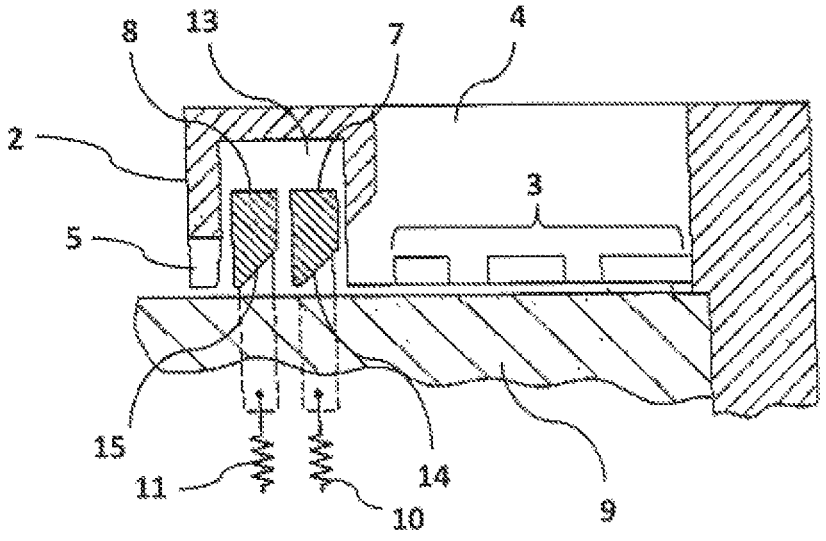
Fig. 2. PRIOR ART
FIG. 2 is a partial sectional elevation view along the line A-A shown in FIG. 1.
Figure 3:
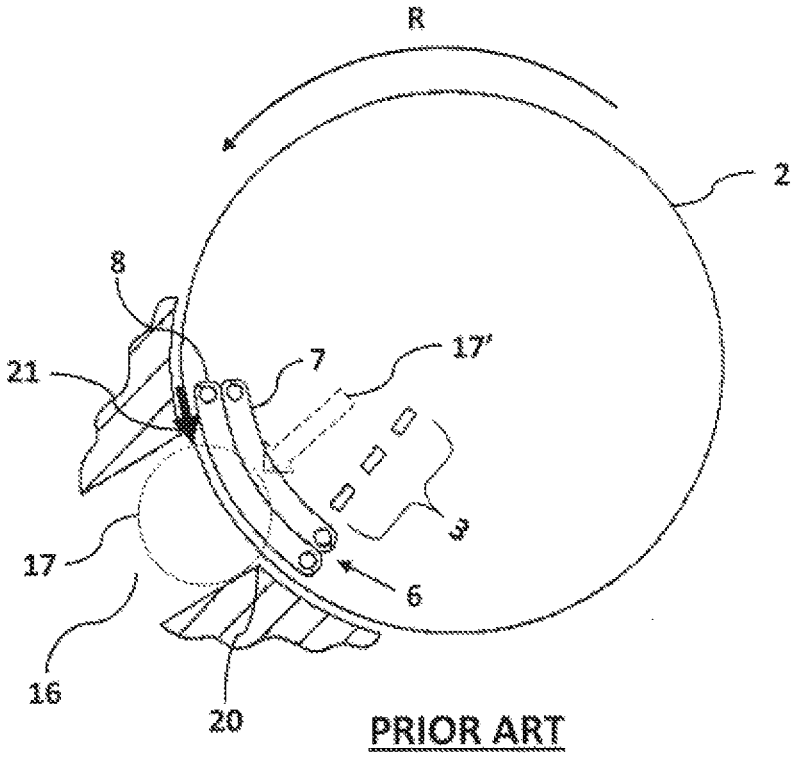
FIG. 3 shows the ejection of a large coin from a prior art coin separating mechanism.
Figure 4:
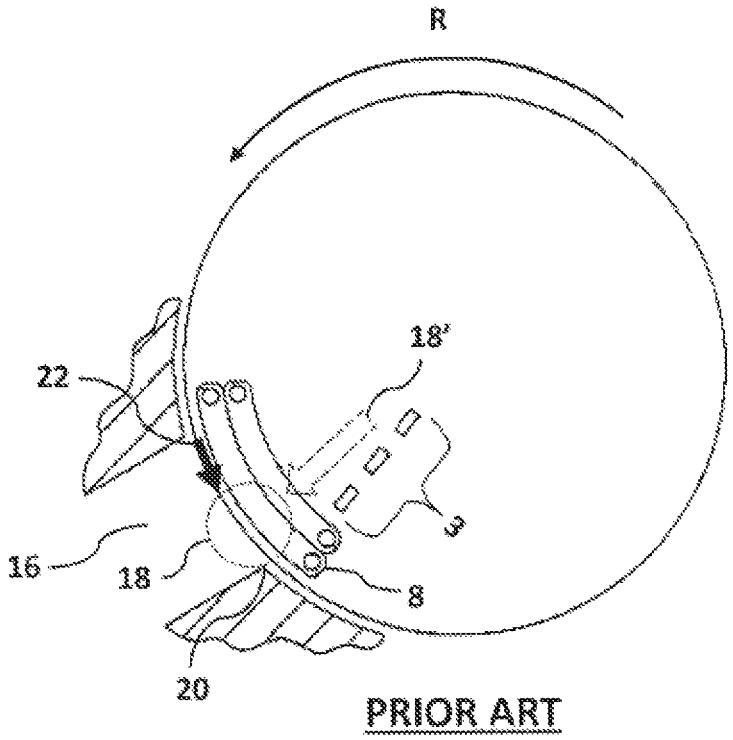
FIG. 4 shows the ejection of a small coin from a prior art coin separating mechanism.

With an outer gate member 34 configured as described above, coins having the greatest thickness can be separated from a bulk supply of coins and directed through the outlet gate whilst also allowing denominations of coins having a small size to be separated and directed through the outlet gate. Advantageously, the problem described above in relation to FIG. 4 does not arise since the underside surface of the outer gate 34 does not contact small coins and therefore no friction force is present.

The invention claimed is:

1. An apparatus (30) for separating a single coin from a plurality of coins comprising:

a rotatable coin disk (2) including at least one coin-retaining aperture (4), said rotatable coin disk configured to transport coins along a dispensing path interconnecting a coin source and a coin outlet aperture (5);

a first gate member; and, a second gate member, said first gate member and said second gate member are adjacent each other and comprise a double outlet gate (6) which closes said coin outlet aperture, wherein the first gate member (33) is a biased moveable coin stripping element and the second gate member (34) is a fixed barrier including an aperture section (37) configured to allow the unhindered passage therethrough of separate coins but block the passage of any coins stacked atop other coins.

2. The apparatus as claimed in claim 1, wherein the fixed barrier aperture section (37) is dimensioned such that it will accommodate the thickest coin that the apparatus is intended to be use with.

3. The apparatus as claimed in claim 2, wherein the fixed barrier aperture section (37) has a height dimension d, and d is in the range 2 mm≤d≤3 mm.

4. The apparatus as claimed in claim 1, wherein the apparatus comprises a motor arranged to drive the rotatable coin disk.

5. The apparatus as claimed in claim 1, wherein the first gate member (33) includes a tapered concave coin contacting surface that is arranged, in use, to translate an urging force of a leading edge of a coin into a displacement force that displaces the first gate member (33) out of the coin dispensing path to allow the coin to pass under said first gate member (33) and through the fixed barrier aperture section (37).

6. The apparatus as claimed in claim 1, wherein the first and second gate members (33, 34) have a complementary arcuate shape.

7. The apparatus of claim 1, wherein the first gate member comprises respective first and second ends which are held in place by spring biased support posts mounted at their respective first and second ends, and wherein the second gate member comprises respective first and second ends which are fixed to a base structure of said apparatus.

8. A coin hopper including an apparatus as claimed in claim 1.

9. The apparatus as claimed in claim 1, wherein the rotatable coin disk (2) is disposed adjacent the coin source for filling the at least one coin-retaining aperture (4), and wherein the apparatus includes a deflecting member (35) configured to urge, in use, a coin located in the at least one coin-retaining aperture towards said coin outlet aperture.

10. The apparatus as claimed in claim 9, wherein the rotatable coin disk (2) includes urging means configured and arranged to cooperate with the deflecting member to urge, in use, a coin located in the at least one coin-retaining aperture along the dispensing path via rotation of the disk.

11. The apparatus as claimed in claim 10, wherein in use the urging means and the deflecting member (35) comb through one another each rotation of the rotatable coin disk so as to provide continuous relative rotational movement between the urging means and the deflecting member.

12. The apparatus as claimed in claim 11, wherein the deflecting member (35) is arranged such that in use it contacts only one coin at a time.

13. The apparatus as claimed in claim 9, wherein the deflecting member (35) is spring biased and is movable into a retracted position to prevent a coin jam.

14. The apparatus as claimed in claim 9, wherein the fixed barrier aperture section (37) is dimensioned such that it will accommodate the thickest coin that the apparatus is intended to be use with.

15. An apparatus for separating a single coin from a plurality of coins in a coin hopper that has a coin source and a coin outlet comprising:

a base;

a rotatable coin disk mounted to said base and including at least one coin-retaining receiver to transport coins entering a coin hopper from a coin source toward a coin outlet along a dispensing path;

a movable gate mounted to said base and movable to allow coins which are stacked from said disk to pass therethrough; and, an immovable gate adjacent said movable gate with said movable gate positioned between said disk and said immovable gate, said immovable gate mounted to said base and forming with said movable gate a double outlet gate positioned to receive coins from said dispensing path of said disk, said immovable gate being fixed to block coins which are stacked to move therethrough while allowing only coins that are not stacked to pass therethough.

* * * * *